US005644811A

United States Patent [19]

Cavazos

[11] Patent Number: 5,644,811

[45] Date of Patent: Jul. 8, 1997

[54] MATTRESS HAVING ACCESS TO MATERIALS SANDWICHED BETWEEN MATTRESS COVER AND INNER CUSHIONING ASSEMBLY

[76] Inventor: Frank G. Cavazos, 14040 Shoshoni Dr., Lockport, Ill. 60441

[21] Appl. No.: 533,032

[22] Filed: Sep. 25, 1995

[51] Int. Cl.[6] ..... A47C 27/045; A47C 27/04

[52] U.S. Cl. ..... 5/738; 5/721

[58] Field of Search ..... 5/738, 737, 716, 5/717, 721

[56] References Cited

U.S. PATENT DOCUMENTS

| | | | |
|---|---|---|---|
| 819,903 | 5/1906 | Maussner | 5/738 |
| 3,493,980 | 2/1970 | Haller | 5/738 |
| 3,950,800 | 4/1976 | Garshfield | 5/738 |
| 4,292,701 | 10/1981 | Woychick | 5/738 |
| 5,432,964 | 7/1995 | Strell | 5/738 |
| 5,435,026 | 7/1995 | Cavazos | 5/721 |

*Primary Examiner*—Alexander Grosz

*Attorney, Agent, or Firm*—Ernest Kettelson

[57] ABSTRACT

A mattress having an innerspring or other cushioning assembly and a mattress cover over both oppositely facing bearing surfaces thereof, the mattress covers each having a peripheral fabric flange extending therefrom in the direction toward the other along and around the peripheral side wall of the mattress, such flanges each being secured to the inner cushioning assembly along and around its peripheral side wall, with a plurality of pads, a urethane foam cushioning layer, and the like sandwiched between each mattress cover and the respective bearing surface of the inner cushioning assembly it covers. The invention comprises openable and closable access means to the sandwiched materials when in its open position, including a zipper assembly or other comparable releasable fastening device extending around the periphery of the fabric flange to which separated upper and lower peripheral portions of each flange are connected. When opened or unzipped, an access opening is provided to reach in for removal and replacement of the materials sandwiched between the mattress covers and the inner cushioning assembly.

28 Claims, 3 Drawing Sheets

MATTRESS HAVING ACCESS TO MATERIALS SANDWICHED BETWEEN MATTRESS COVER AND INNER CUSHIONING ASSEMBLY

BACKGROUND OF THE INVENTION

This invention relates to the field of mattresses which have mattress covers over both oppositely facing bearing surfaces of an innerspring assembly, or other inner cushioning assembly, and various layers of mattress making materials sandwiched between the respective mattress covers and the respective bearing surfaces of the inner cushioning assembly which they cover. In particular, the invention in this case relates to and provides a way to gain access to the materials sandwiched between the mattress covers and cushioning assembly bearing surfaces for replacement and repair without having to replace the entire mattress including those parts which are still good.

Relevant prior art of which the inventor is aware include the inventor's own patent and patent applications as follows.

The inventor's own U.S. Pat. No. 5,435,026 discloses a novel mattress clip for securing the fabric flange of a mattress cover to the coils of an innerspring assembly, which clip may be used with the mattress in accordance with this invention but any other kind of clip may also be used to secure a portion of the fabric flange to the innerspring or other inner cushioning assembly within the scope of this invention. U.S. Pat. No. 5,435,026 also discloses a do-it-yourself type of mattress which can be put together by the customer after purchasing the necessary component parts.

The inventor's own concurrent U.S. patent application Ser. No. 08/203,100 now U.S. Pat. No. 5,471,688 discloses a modular innerspring assembly for a mattress and a modular box spring assembly on which the mattress is placed.

The inventor's own concurrent U.S. patent application Ser. No. 08/254,735 now U.S. Pat. No. 5,485,639 discloses an S-shaped metal connecting clip having a spring characteristic to more easily connect the border wire around the top and bottom of an innerspring assembly to the top and bottom coils of adjacent coil springs.

The inventor's own concurrent U.S. patent application Ser. No. 08/254,740 now abandoned discloses a mattress cover having a peripheral fabric flange extending around its periphery, in which the free end of the fabric flange has a reinforced hem, such as a cord through a peripheral sleeve extending around the free edge of the fabric flange.

Other prior art of which the inventor is aware that may have some relevance to the present invention include the following.

U.S. Pat. No. 5,214,809 discloses an articulated mattress for an adjustable bed which has hinge portions between mattress sections for limited pivotal movement of one section relative to another.

U.S. Pat. No. 5,040,255 discloses a cushion or mattress structure comprising a box structure with side, top and bottom walls of foam material, and cavity within the box to receive encased springs.

U.S. Pat. No. 4,956,884 discloses a modular box spring mattress comprising a plurality of plate sub units in which coil springs are received and held by flexible retaining arms. The sub units have cooperative coupling structures to hold adjacent sub units together.

U.S. Pat. No. 4,868,941 discloses an assembled mattress having an upper sheet with integrally formed sleeves or bellows extending downward and a lower sheet with integrally formed sleeves or bellows extending upward, with individual coil springs seated in each of the sleeves or bellows.

U.S. Pat. No. 2,556,400 discloses a wire drapery hanger having an inverted V-shaped clamp portion for placing over a horizontal support bar and an elongated upwardly extending leg which terminates in a point adjacent a hook portion in which it is received when pressed into its closed position.

U.S. Pat. No. 2,547,840 discloses a sectional mattress comprising three separate sections positioned end to end, with one end of a coil spring connected at each end of the middle section and on both sides thereof, having the other end of each coil spring connected to the adjacent mattress section at each opposite end of the middle section.

U.S. Pat. No. 2,446,775 discloses an innerspring mattress construction made up of sections which are glued together along facing end walls to make up a completed mattress.

U.S. Pat. No. 2,354,848 discloses a clip device for a fish stringer comprising a loop through which a string is received and secured, a generally U-shaped portion which has an upwardly extending leg that terminates in a pointed free end adjacent a hook portion in which it is received when pressed into its closed position.

U.S. Pat. No. 2,287,226 discloses a securing means to secure the fabric of an upholstered piece to a coil spring, comprising a thin strip of metal having a flat top or intermediate portion bent downwardly at one end with a pair of spaced apart curving hook-like arms which pierce the upholstery fabric, then draw it against the coil spring which is received between the spaced apart hook-like arms, the opposite end of the thin strip having a depending portion with a notch to slip over the facing portion of the coil spring.

U.S. Pat. No. 2,249,266 discloses a combined chair and bed having a mattress like coil spring cushion supported on a hinged frame which folds down into a bed and angularly to form a chair in one position and a recliner in another.

U.S. Pat. No. 2,224,161 discloses a suspended support device made of a single strand of wire to form a pair of spaced apart hooks, spaced apart suspension members, a horizontal carrying member and a hook latch for releasably retaining and supporting the projecting end of the horizontal carrying member.

U.S. Pat. No. 2,216,991 discloses three mattress units which are connected end to end to make a complete mattress. The units are connected by a transverse cylindrical bar insert on one unit which is received in a sleeve have a split cylindrical wall around its through passageway on the adjacent unit.

U.S. Pat. No. 2,168,076 discloses an upholstery staple having a pair of parallel legs connected at their inner ends by a U-shaped bridge which extends at right angles to the legs, one leg being relatively short terminating at a sharp point, the other leg being relatively longer and curving downwardly near its free end which then also terminates at a sharp point.

U.S. Pat. No. 1,915,674 discloses a coil spring assembly for making cushions, comprising four or more coils in a row connected by an elongated endless loop of twisted wire which includes one elongated strand connected to one side of each coil in the row and a second parallel strand connected to the opposite side of each coil in the row, such rows of coils in turn being connected to adjacent rows of coils by C-wires or fasteners known as hog rings.

U.S. Pat. No. 1,875,628 discloses a tufting button comprising a combined ring and fastening clip formed of one piece, covering material over the ring portion, the fastening clip portion having an elongated leg terminating in a sharp point and a curved leg terminating in a hook to hook over the coil spring of an upholstered item after passing through the upholstery material.

U.S. Pat. No. 1,828,012 discloses a drapery pin having an elongated leg which terminates in a sharp point at its free end, is integrally joined to a loop at its opposite end, and a hook member extending from the opposite end of the coil having its hook end biased outwardly from the free end of the elongated leg which can be pressed toward the hook and received therein to close the drapery pin.

U.S. Pat. No. 1,608,705 discloses a fastening clip to connect a coil spring to an adjacent coil spring, comprising a continuous length of wire formed into a generally triangular shape, having one leg as the base integrally joined at one end to a first diagonally extending leg with the coil of one spring extending through the angle formed thereby, the base leg integrally joined at its opposite end to a second diagonally extending leg with the coil of a second spring extending through the angle formed thereby, the first and second diagonal legs terminating in cooperating hook portions to connect the two together.

U.S. Pat. No. 1,459,540 discloses a sectional mattress comprising three separate sections that are laid end to end to make up a complete mattress and can be interchanged in their relationship to each other. The innersprings within each section are encased in bags.

U.S. Pat. No. 1,269,660 discloses a tatting hook and fastener, the fastener comprising a single strand of wire, a first leg terminating in a point at its free end, integrally joined to a loop at its opposite end, a second leg extending from the opposite side of the loop parallel to the first leg, the second leg terminating in a bent portion to provide a pair of laterally extending eyes, then a loop at right angles to the eyes and finally formed into a hook positioned adjacent the pointed free end of the first leg for reception by the hook.

U.S. Pat. No. 879,232 discloses a bale tie fastener comprising a continuous length of wire, a first leg having a free end, its opposite end integrally joined to a loop, a second leg extending from the opposite side of the loop which terminates in a hook at a location biased outwardly from the free end of the first leg which can be pressed toward the hook end of the second leg and received therein to close the tie fastener.

SUMMARY OF THE INVENTION

The mattress in accordance with the present invention provides an improvement over the prior art. It provides a way to gain access to the pads and cushioning materials which are sandwiched between the mattress covers and the innerspring or other inner cushioning assembly that may be used, for removal and repair or replacement. These include insulators of various types, such as a wire or polypropylene mesh, a natural or synthetic fiber pad, a polyurethane foam pad and the like. Such pads and layers of material often become damaged or worn out while other parts of the mattress are still good. This invention enables the owner of the mattress to gain access to these materials sandwiched between the mattress covers and the bearing surfaces on each opposite side of the innerspring or whatever inner cushioning device is used.

The invention separates the peripheral fabric flange that extends from the peripheral edge of the mattress cover into two peripherally extending flange portions. One extends down from the cover connecting edge of the flange which is connected to the peripheral edge of the mattress cover and terminates in a first peripherally extending zipper connecting edge for connection to one side of a peripherally extending zipper assembly or other fastening device. The other peripherally extending flange portion extends up from the free edge of the original flange toward the connecting edge and terminates in a second peripherally extending zipper connecting edge.

An elongated zipper assembly or other elongated fastening device is secured between the first and second zipper connecting edges of the two respective flange portions, whereby they may be separated when the zipper is unzipped and re-connected when the zipper is zipped back up again.

The flange portion which extends up from the free edge and terminates at the second peripherally extending zipper connecting edge is secured to the adjacent coil springs of the innerspring assembly or to a facing portion of whatever other type of inner cushioning assembly may be used.

When access is desired to the pads and cushioning materials which are sandwiched between the mattress cover and the bearing surface of the innerspring or other inner cushioning assembly, the zipper assembly is unzipped to separate the flange portion which extends from the connecting edge adjacent the peripheral edge of the mattress cover and the flange portion which extends from the free edge to the second peripherally extending zipper free edge and which remains connected to the inner cushioning assembly. After the flange portions are separated, the pads and other materials sandwiched between the mattress cover and inner cushioning assembly can be removed and replaced. When replaced the zipper assembly is zipped back up to reconnect the two flange portions.

A border strip extends around the peripheral side wall of the mattress between the top and bottom mattress covers. The border strip may be secured to one or both of such mattress pads by zipper assemblies, whereby the border strip may simply be unzipped to gain access to the mattress flanges having the separable flange portions connected by a zipper.

The zipper assembly of the flanges may also be secured between the peripheral edge of the mattress cover and the connecting edge of the entire flange. In such case, the entire fabric flange may be unzipped from the mattress cover for access to whatever is under the mattress cover, and zipped back up again to reconnect the mattress cover to the flange.

DESCRIPTION OF PREFERRED EMBODIMENT

Figure 1:
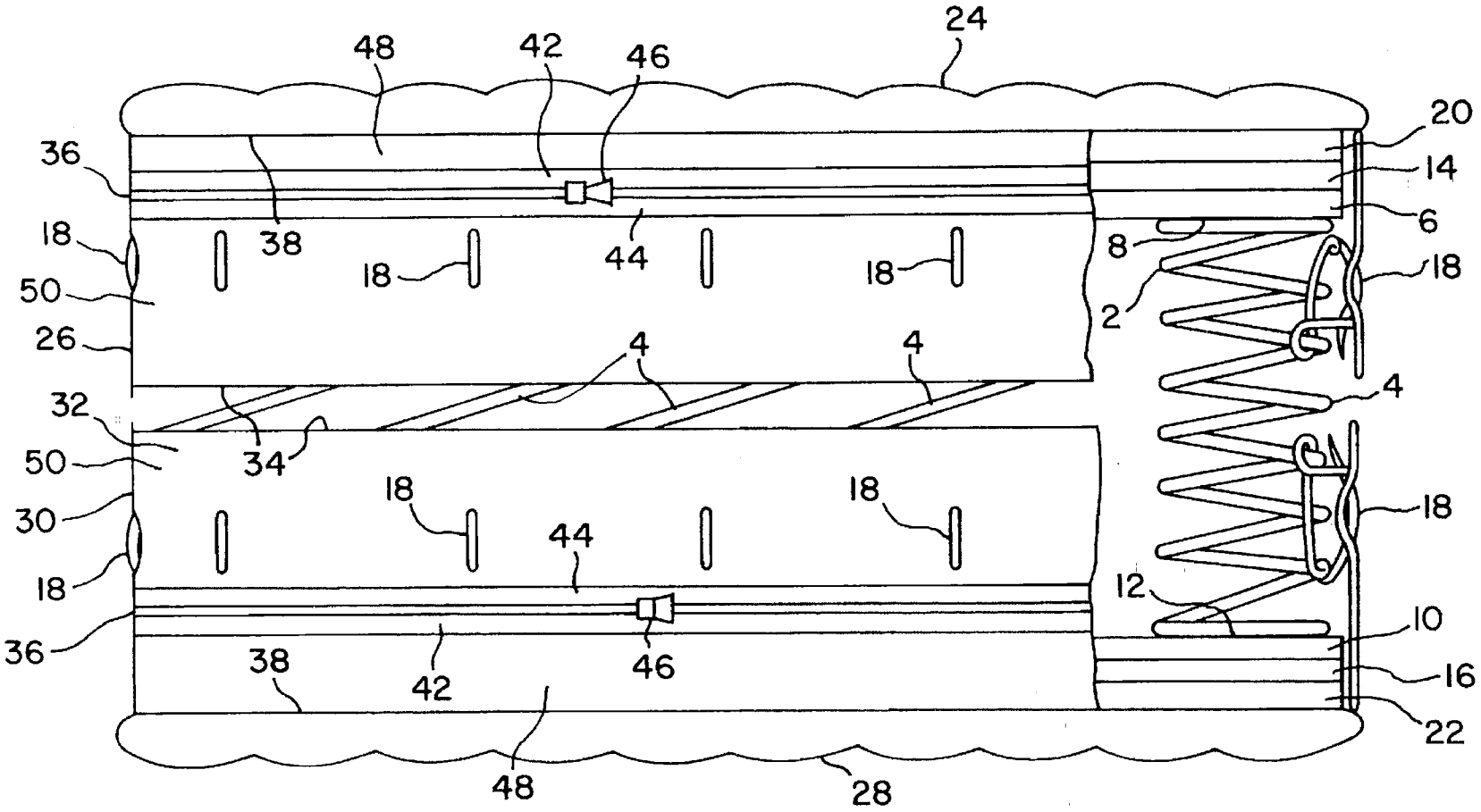
FIG. 1 is a side elevation view of a mattress in accordance with this invention with the border strip removed and a portion of the peripherally extending fabric flanges broken away to see the innerspring assembly and the layers of material under the mattress covers.
Figure 2:
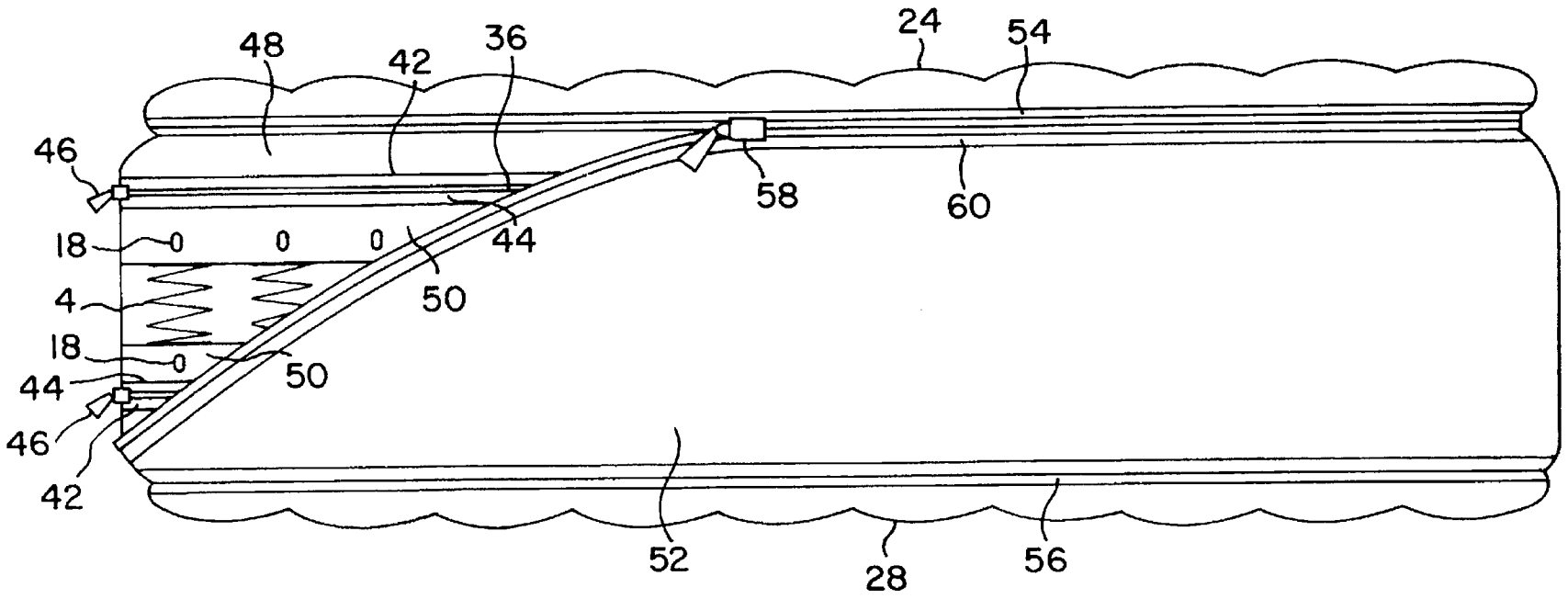
FIG. 2 is a side elevation of a mattress in accordance with this invention showing the peripherally extending border strip in place, partially unzipped to show access to the zipped together fabric flange portions.
Figure 3:
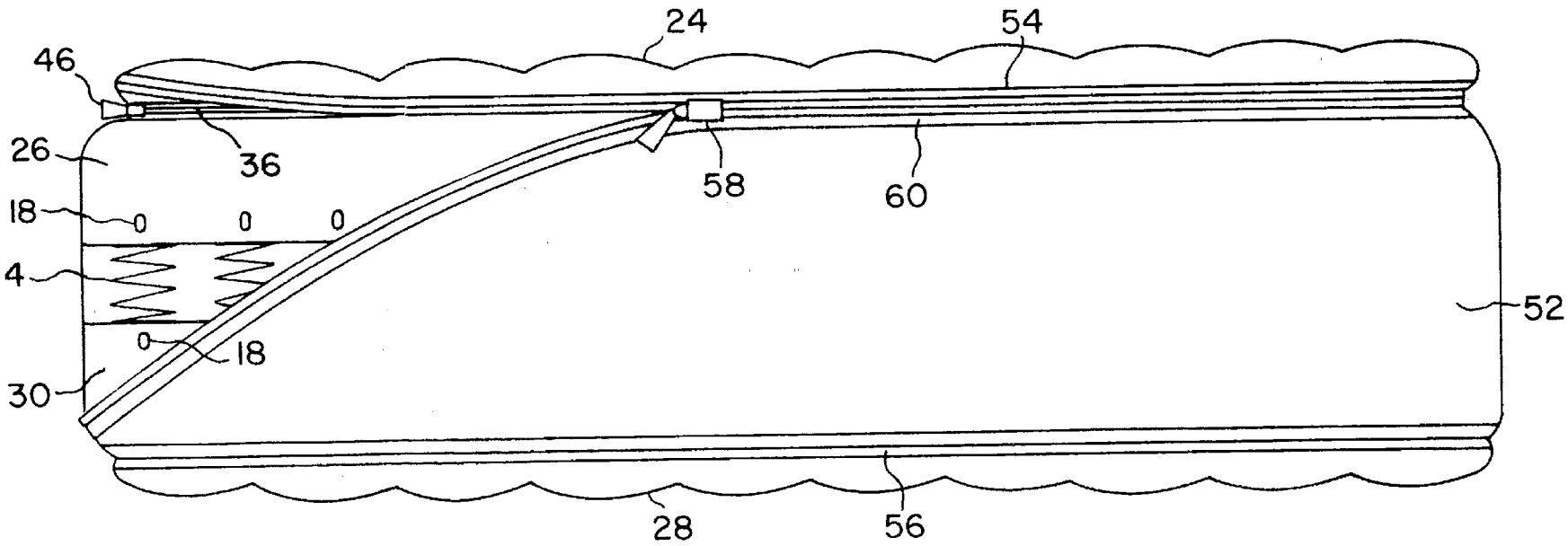
FIG. 3 is a side elevation view of a modified form of the invention in which the border strip is partially opened to illustrate the fabric flange releasably connected directly to the mattress cover by a zipper assembly.

A conventional mattress includes an innerspring assembly 2 having a plurality of coil springs 4. A first layer of insulating material 6 is placed over the upwardly facing surface 8 of the mattress and innerspring assembly 2, and a second layer of insulating material 10 is placed over the downwardly facing surface 12 thereof. These insulating layers may be of a wire or polypropylene mesh.

A first natural or synthetic fiber pad 14 is placed over the first layer of insulating material 6. A second such pad 16 is placed over the second layer of insulating material 10.

The corners of the layers of insulating material 6 and 10, and of the pads 14 and 16 are secured to adjacent ones of the coil springs 4 by mattress clips 18.

A first polyurethane foam pad 20 is placed over the layer of insulating material 6 and pad 14. A second polyurethane foam pad 22 is placed over the layer of insulating material 10 and pad 16. The corners of the polyurethane pads are also secured to adjacent ones of the coil springs 4 by mattress clips 18.

A first mattress cover 24 having a fabric flange 26 hanging down and extending around its entire peripheral edge is placed over the first polyurethane foam pad 20. A second mattress cover 28 having a fabric flange 30 extending from and around the entire mattress cover is placed over the second polyurethane foam pad 22. The fabric flange 30 is shown in the drawing is extending upwardly from the mattress cover 28 which is shown in the drawing as covering the downwardly facing surface 12 of the mattress assembly.

The peripheral fabric flanges 26 and 30 extend at substantially right angles to the plane of the respective mattress covers 24 and 28 around the entire periphery of the mattress to cover facing portions of the peripheral side wall 32 of the mattress. The fabric flanges 26 and 30 are secured to each adjacent coil spring 4 by mattress clips 18 which perforate and extend through the fabric flanges 26 and 30 inwardly of and adjacent their respective peripheral free edges 34.

In accordance with the present invention a peripheral zipper assembly 36 extends around the entire periphery of each of the fabric flanges 26 and 30, parallel to their respective free edges 34 and spaced apart inwardly thereof about midway between the respective peripheral free edges 34 of the fabric flanges and the respective peripheral connecting edges 38 which connect the fabric flange 26 to mattress cover 24 and the fabric flange 30 to mattress cover 28.

The zipper assembly 36 comprises an elongated row of releasable inter-engaging teeth or other inter-engaging zipper means such as two continuous elongated inter-engaging flanges, half, or one, of which are secured to the edge of a first elongated strip 42 of flexible sheet material along one side and half, or the other one, of which are secured to the edge of a second elongated strip 44 of flexible sheet material along the other side. A zipper operator 46 slides along the elongated row of releasable inter-engaging members, receiving the inter-engaging members along the edge of each strip 42 and 44 in a channel which brings the inter-engaging members together in releasable inter-engagement when slidingly moved in one direction and separates the inter-engaging members when the zipper operator 46 is slidingly moved in the opposite direction.

The zipper assembly 36 is secured to each respective fabric flange 26 and 30 as follows. Elongated zipper assemblies 36 are selected, each having a length which is equal to the dimension around the entire periphery of one of the fabric flanges which extend around the periphery of the mattress. With such elongated zipper assembly 36 in its inter-engaged position in which each strip 42 and 44 of flexible sheet material along each side of the zipper assembly are connected together, the zipper assembly is placed in position parallel to the free edge 34 about midway between the free edge 34 and the connecting edge 38. The strips 42 and 44 of the zipper assembly are then sewn to the fabric flange at such location around the entire periphery of the fabric flange.

The zipper operator 46 is then slidingly moved in the direction which separates the inter-engaged zipper members along the adjacent edges of each strip 42 and 44 of the zipper assembly. The strips 42 and 44 sewn to the fabric flange are thus separated along their edges having the zipper members which exposes a peripheral facing portion of the fabric flange which lies immediately below the row of inter-engaging zipper members when they are inter-engaged. The fabric flange is then cut along that peripheral facing portion, which separates the fabric flange into two peripherally extending portions. The first peripheral fabric flange portion 48 extends around the entire periphery of the mattress cover and flange between connecting edge 38 and zipper strip 42. The second peripheral fabric flange portion 50 extends around the entire periphery of the mattress cover and flange between zipper strip 44 and the free edge 34 of the flange.

The first and second peripheral fabric flange portions 48 and 50 can thus be joined together by placing side by side with their respective zipper strips 42 and 44 facing each other for inter-engagement of the zipper members, then sliding the zipper operator 46 in the direction which causes the members to inter-engage and thus connect the two flange portions.

The mattress covers 24 and 28 with their respective fabric flanges 26 and 30 having their fabric flange portions 48 and 50 connected together by the zipper assembly 36 are then secured to the innerspring assembly 2 by mattress clips 18 as described above.

The mattress clips 18 perforate and extend through only the second fabric flange portion which extends between free edge 34 and zipper strip 44 to connect the second fabric flange portion to the innerspring assembly 2. The first fabric flange portion which extends between connecting edge 38 and zipper strip 42 is not connected to the innerspring assembly 2 by any mattress clips. Thus, after the mattress covers 24 and 28 with their respective fabric flanges are connected to the innerspring assembly by mattress clips through their second fabric flange portion only, the mattress covers 24 and 28 with the first fabric flange portions of the respective fabric flanges 26 and 30 can be opened by "unzipping," i.e. by sliding the zipper operator 46 in the direction which separates the inter-engaging zipper members. This permits access to the area under the mattress covers 24 and 28 for such purposes as to remove and repair or replace the layers of insulating material 8 and 10 if necessary, the fiber pads 14 and 16 if necessary, and the foam pads 20 and 22 if necessary. When replaced, the mattress covers 24 and 28 can simply be zipped up connecting the first fabric flange portion 48 to the second fabric flange portion 50, with no need to use mattress clips again to secure the fabric flanges of the mattress covers to adjacent springs.

A peripheral border strip 52 extends around the entire periphery of the mattress to cover the entire peripheral side wall 32 of the mattress from the peripheral edge 54 around mattress cover 24 covering the upwardly facing surface 8, to the peripheral edge 56 around mattress cover 28 covering the downwardly facing surface 12. A peripheral zipper assembly 58 may be provided around the peripheral edge 54 of mattress cover 24 and corresponding peripheral edge 60 of the border strip 52 whereby such edges may be separated and closed by "unzipping" and "zipping up" respectively of the peripheral zipper assembly 58. Access to the fabric flanges 26 and 30 of the mattress covers 24 and 28, and their zipped together first and second flange portions can be obtained by merely unzipping the peripheral zipper assembly 58 to separate the border strip 52 along its peripheral edge 60 from the corresponding peripheral edge 54 of mattress cover 24.

It is within the scope of the invention to connect the flanges 26 and 30 directly to their respective mattress covers 24 and 28 by the zipper assembly 36, in which case the flanges do not have to be divided into two peripherally extending portions. They are covered by the border strip 52 in the same manner as described above, which is also releasably connected along at least one peripheral edge to the adjacent mattress cover by the peripheral zipper assembly 58.

I claim:

1. A mattress comprising an inner cushioning assembly having an upwardly facing bearing surface, at least one layer of material over said upwardly facing bearing surface, a first mattress cover over said layer of material, said first mattress cover having a first flange of flexible sheet material extending from the peripheral edge of said first mattress cover, said first flange having a first connecting edge connected to said first mattress cover and a first opposite free edge, said first flange comprising a connecting edge adjacent flange portion extending from said connecting edge of said first flange toward said free edge of said first flange terminating in a first zipper connecting edge of said first flange and a free edge adjacent flange portion of said first flange extending from said free edge of said first flange toward said connecting edge of said first flange terminating in a second zipper connecting edge of said first flange, a first zipper assembly connected along one side thereof to said first zipper connecting edge of said first flange and along the other side to said second zipper connecting edge of said first flange, and flange securing means connecting said free edge adjacent flange portion of said first flange to said inner cushioning assembly, said first zipper assembly being operable between an inter-engaged and a separated position, said first mattress cover and said connected edge adjacent flange portion of said first flange being separable from said free edge adjacent flange portion of said first flange secured to said inner cushioning assembly when said first zipper assembly is in its said separated position for access to said layer of material over said upwardly facing bearing surface and under said first mattress cover.

2. A mattress as set forth in claim 1, wherein said inner cushioning assembly includes an oppositely facing bearing surface, at least one layer of material over said oppositely facing bearing surface, a second mattress cover over said layer of material over said oppositely facing bearing surface, said second mattress cover having a second flange of flexible sheet material extending from the peripheral edge of said second mattress cover, said second flange having a second connecting edge connected to said second mattress cover and a second opposite free edge, said second flange comprising a connected edge adjacent flange portion extending from said connecting edge of said second flange toward said free edge of said second flange terminating in a first zipper connecting edge of said second flange and a free edge adjacent flange portion of said second flange extending from said free edge of said second flange toward said connecting edge of said second flange terminating in a second zipper connecting edge of said second flange, a second zipper assembly connected along one side thereof to said first zipper connecting edge of said second flange and along the other side to said second zipper connecting edge of said second flange, and flange securing means connecting said free edge adjacent flange portion of said second flange to said inner cushioning assembly, said second zipper assembly being operable between an inter-engaged and a separated position, said second mattress cover and said connected edge adjacent flange portion of said second flange being separable from said free edge adjacent flange portion of said second flange secured to said inner cushioning assembly when said second zipper assembly is in its said separated position for access to said layer of material over said oppositely facing bearing surface and under said second mattress cover.

3. A mattress as set forth in claim 2, wherein said mattress includes a peripheral side wall extending entirely around the periphery of said mattress between said first mattress cover over said upwardly facing surface of said inner cushioning assembly and said second mattress cover over said oppositely facing bearing surface of said inner cushioning assembly, including a peripheral border strip extending between said first and second mattress covers and over said peripheral side wall around the periphery of said mattress.

4. A mattress as set forth in claim 3, wherein said mattress includes access means to obtain access to said first and second zipper assemblies of said respective first and second flanges of said respective first and second mattress covers for moving said zipper assemblies from their inter-engaged to their separated positions for access to said layers of material over said bearing surfaces of said inner cushioning assembly and under said respective first and second mattress covers.

5. A mattress as set forth in claim 4, wherein said access means includes border strip separating means to separate at least a portion of said border strip from a one of said first and second mattress covers.

6. A mattress as set forth in claim 5, wherein said border strip separating means include a zipper assembly connected between adjacent portions of said border strip and a one of said first and second mattress covers.

7. A mattress as set forth in claim 1, wherein said one layer of material over said upwardly facing bearing surface comprises mattress making material, a plurality of additional layers of mattress making materials over said first stated one layer.

8. A mattress as set forth in claim 7, wherein said mattress making materials include a pad of mesh material, a pad of fiber material and a pad of foam material.

9. A mattress as set forth in claim 1, wherein said one layer of material over said upwardly facing bearing surface comprises an insulator pad of mesh material, including a pad of fiber material over said insulator pad of mesh material, and a cushioning pad of foam material over said pad of fiber material.

10. A mattress as set forth in claim 1, wherein said flange securing means include mattress clips which perforate and extend through said flange of said mattress cover and which are securable to said inner cushioning assembly.

11. A mattress as set forth in claim 1, wherein said inner cushioning assembly comprises an innerspring assembly having a plurality of springs.

12. A mattress comprising an inner cushioning assembly having an upwardly facing bearing surface, at least one layer of material over said upwardly facing bearing surface, a mattress cover over said layer of material, said mattress cover having a flange of flexible sheet material extending from the peripheral edge of said mattress cover, said flange having a connecting edge connected to said mattress cover and an opposite free edge, said flange comprising a first flange portion extending from said connecting edge toward said free edge of said flange and terminating in a first releasably connectable edge and a second flange portion extending from said free edge toward said connecting edge of said flange and terminating in a second releasably connectable edge, releasable connecting means to releasably connect said first releasably connectable edge to said second releasably connectable edge, flange securing means connecting said second flange portion to said inner cushioning assembly, said releasable connecting means being operable between a securing position wherein said first and second flange portions and their respective first and second releasably connectable edges are connected together and a released position wherein said first and second flange portions and their respective first and second releasably connectable edges are separated, an access entrance to remove and replace said layer of material over said bearing surface of said inner cushioning assembly being provided when said releasable connecting means is in its said released position whereby said first flange portion is separated from said second flange portion which is secured to said inner cushioning assembly.

13. A mattress as set forth in claim 12, wherein said inner cushioning assembly includes an oppositely facing bearing surface, a second mattress cover over said oppositely facing bearing surface, said second mattress cover having a flange extending from the peripheral edge of said second mattress cover secured to said inner cushioning assembly by said flange securing means, at least one layer of material sandwiched between said oppositely facing bearing surface and said second mattress cover, and access means operable between an open and closed position to provide access to said layer of material sandwiched between said oppositely facing bearing surface and said second mattress cover when said access means is in its said open position.

14. A mattress as set forth in claim 13, wherein said mattress includes a peripheral side wall extending entirely around the periphery of said mattress between said first mentioned mattress cover over said upwardly facing bearing surface of said inner cushioning assembly and said second mattress cover over said oppositely facing bearing surface of said inner cushioning assembly, including a peripheral border strip extending between said first mentioned mattress cover and said second mattress cover and over said peripheral side wall around the periphery of said mattress.

15. A mattress as set forth in claim 14, wherein said mattress includes second access means to obtain access to said releasable connecting means and to said first mentioned access means which are behind said peripheral border strip over said peripheral side wall around the periphery of said mattress.

16. A mattress as set forth in claim 15, wherein said second access means includes border strip separating means to separate at least a portion of said border strip from a one of said first mentioned mattress cover and said second mattress cover.

17. A mattress as set forth in claim 16, wherein said border strip separating means include a zipper assembly connected between adjacent portions of said border strip and a one of said first mentioned mattress covers and said second mattress cover.

18. A mattress as set forth in claim 12, wherein said inner cushioning assembly comprises an innerspring assembly having a plurality of springs.

19. A mattress as set forth in claim 18, wherein said flange securing means include mattress clips which perforate and extend through said flange of said mattress cover and which are securable to respective ones of said plurality of springs of said innerspring assembly.

20. A mattress comprising an inner cushioning assembly having a bearing surface, at least one layer of material over said bearing surface, a mattress cover over said layer of material, said mattress cover having a peripheral edge therearound, a flange of flexible sheet material extending from said peripheral edge of said mattress cover, said flange having a mattress cover adjacent edge extending around the periphery of said mattress cover and adjacent thereto, a peripherally extending fastening assembly connected between said mattress cover adjacent edge of said flange and said peripheral edge of said mattress cover, said peripherally extending fastening assembly being movable between a fastened position in which said flange is connected to said mattress cover and an unfastened position in which said flange is separated from said mattress cover, and a plurality of flange securing means, around the periphery of said flange, to secure said flange to said inner cushioning assembly.

21. A mattress as set forth in claim 20, wherein said peripherally extending fastening assembly comprises an elongated zipper assembly extending around the entire periphery of said mattress cover and said flange.

22. A mattress comprising an inner cushioning assembly having a bearing surface, a plurality of layers of mattress making materials, including a mattress cover over said bearing surface, said mattress cover having a flange extending from the peripheral edge of said mattress cover secured to said inner cushioning assembly by a plurality of flange securing means, around the periphery of said flange, at least one layer of material sandwiched between said mattress cover and said bearing surface of said inner cushioning assembly, and access means operable between an open and closed position to provide access to said layer of material sandwiched between said mattress cover and said bearing surface of said inner cushioning assembly when said access means is in its said open position.

23. A mattress as set forth in claim 22, wherein a one of said plurality of layers of mattress making materials is adjacent to said at least one layer of material sandwiched between said mattress cover and said bearing surface of said inner cushioning means, said access means including releasable securing means connected to said one of said plurality of layers of mattress making materials operable between an open position and a closed position to provide access to said at least one layer of material sandwiched between said mattress cover and said bearing surface of said inner cushioning material when said releasable securing means is in its said open position.

24. A mattress as set forth in claim 23, wherein said releasable securing means comprises a zipper assembly.

25. A mattress comprising an inner cushioning assembly having an upwardly facing bearing surface, a first mattress cover over said upwardly facing bearing surface, said first mattress cover having a first flange of flexible sheet material extending from the peripheral edge of said first mattress cover, said first flange having a first connecting edge connected to said first mattress cover and a first opposite free edge, said first flange comprising a connecting edge adjacent flange portion extending from said connecting edge of said first flange toward said free edge of said first flange terminating in a first zipper connecting edge of said first flange and a free edge adjacent flange portion of said first flange extending from said free edge of said first flange toward said connecting edge of said first flange terminating in a second zipper connecting edge of said first flange, a first zipper assembly connected along one side thereof to said first zipper connecting edge of said first flange and along the other side to said second zipper connecting edge of said first flange, and flange securing means connecting said free edge adjacent flange portion of said first flange to said inner cushioning assembly, said first zipper assembly being operable between an inter-engaged and a separated position, said first mattress cover and said connected edge adjacent flange portion of said first flange being separable from said free edge adjacent flange portion of said first flange secured to said inner cushioning assembly when said first zipper assembly is in its said separated position.

26. A mattress as set forth in claim 25, wherein said inner cushioning assembly includes an oppositely facing bearing surface, a second mattress cover over said oppositely facing bearing surface, said second mattress cover having a second flange of flexible sheet material extending from the peripheral edge of said second mattress cover, said second flange having a second connecting edge connected to said second mattress cover and a second opposite free edge, said second flange comprising a connected edge adjacent flange portion extending from said connecting edge of said second flange toward said free edge of said second flange terminating in a first zipper connecting edge of said second flange and a free edge adjacent flange portion of said second flange extending from said free edge of said second flange toward said connecting edge of said second flange terminating in a second zipper connecting edge of said second flange, a second zipper assembly connected along one side thereof to said first zipper connecting edge of said second flange and along the other side to said second zipper connecting edge of said second flange, and flange securing means connecting said free edge adjacent flange portion of said second flange to said inner cushioning assembly, said second zipper assembly being operable between an inter-engaged and a separated position, said second mattress cover and said connected edge adjacent flange portion of said second flange being separable from said free edge adjacent flange portion of said second flange secured to said inner cushioning assembly when said second zipper assembly is in its said separated position.

27. A mattress comprising an inner cushioning assembly having an upwardly facing bearing surface, a mattress cover over said upwardly facing bearing surface, said mattress cover having a flange of flexible sheet material extending from the peripheral edge of said mattress cover, said flange having a connecting edge connected to said mattress cover and an opposite free edge, said flange comprising a first flange portion extending from said connecting edge toward said free edge of said flange and terminating in a first releasably connectable edge and a second flange portion extending from said free edge toward said connecting edge of said flange and terminating in a second releasably connectable edge, releasable connecting means to releasably connect said first releasably connectable edge to said second releasably connectable edge, flange securing means connecting said second flange portion to said inner cushioning assembly, said releasable securing means being operable between a securing position wherein said first and second flange portions and their respective first and second releasably connectable edges are connected together and a released position wherein said first and second flange portions and their respective first and second releasably connectable edges are separated.

28. A mattress as set forth in claim 27, wherein said inner cushioning assembly includes an oppositely facing bearing surface, a second mattress cover over said oppositely facing bearing surface, said second mattress cover having a flange extending from the peripheral edge of said second mattress cover secured to said inner cushioning assembly, and access means operable between an open and closed position to provide access to said oppositely facing bearing surface under said second mattress cover when said access means is in its said open position.

* * * * *